US005346350A

United States Patent [19]

Luhman et al.

[11] Patent Number: 5,346,350

[45] Date of Patent: * Sep. 13, 1994

[54] HOT MELT ADHESIVE APPLICATOR

[75] Inventors: Robert A. Luhman, Deer Park, Wis.; Gary K. Kuhn, Scandia, Minn.; Kenneth J. Perrington, Maplewood, Minn.; Karl M. Kropp, St. Paul, Minn.; Michael W. Gruber, Huntsville, Ala.

[73] Assignee: Minnesota Mining and Manufacturing Company, St. Paul, Minn.

[ * ] Notice: The portion of the term of this patent subsequent to Oct. 6, 2009 has been disclaimed.

[21] Appl. No.: 163,151

[22] Filed: Dec. 6, 1993

Related U.S. Application Data

[63] Continuation of Ser. No. 876,486, Apr. 30, 1992, which is a continuation of Ser. No. 594,640, Oct. 4, 1990, Pat. No. 5,152,654.

[51] Int. Cl.[5] ..... B42C 9/02

[52] U.S. Cl. ..... 412/37; 412/26; 412/902

[58] Field of Search ..... 412/8, 26, 27, 33, 37, 412/902; 281/21.1; 156/212, 384, 378, 489, 412

[56] References Cited

U.S. PATENT DOCUMENTS

| | | | |
|---|---|---|---|
| 2,455,971 | 12/1948 | Bosch | 11/1 |
| 3,531,358 | 9/1970 | Rost et al. | 156/475 |
| 3,532,363 | 10/1970 | Abildgaard et al. | 281/29 |
| 3,616,074 | 10/1971 | Hoff et al. | 156/477 B |
| 3,717,366 | 2/1973 | Decker | 281/21 R |
| 3,739,412 | 6/1973 | Card et al. | 11/5 |
| 3,757,736 | 9/1973 | Anderson | 118/59 |
| 3,788,921 | 1/1974 | Polit et al. | 412/8 |
| 3,863,596 | 2/1975 | Anderson | 118/5 |
| 3,866,568 | 2/1975 | Minami | 118/238 |
| 3,920,501 | 11/1975 | Carlton et al. | 156/364 |
| 3,926,712 | 12/1975 | Wetzler et al. | 156/477 B |
| 3,930,082 | 12/1975 | Waldeck | 428/255 |
| 4,116,750 | 9/1978 | Lewis et al. | 156/563 |
| 4,129,471 | 12/1978 | Rome | 156/211 |
| 4,187,571 | 2/1980 | Astero | 412/37 |
| 4,230,514 | 10/1980 | Becker et al. | 412/37 X |
| 4,244,069 | 1/1981 | Hale | 11/1 |
| 4,289,330 | 9/1981 | Wiermanski | 281/21.1 |
| 4,376,008 | 3/1983 | Lauri et al. | 156/578 |
| 5,013,200 | 5/1991 | Hunder et al. | 412/6 |
| 5,152,654 | 10/1992 | Luhman et al. | 412/37 |

FOREIGN PATENT DOCUMENTS

| | | |
|---|---|---|
| 4-5091 | 1/1992 | Japan . |
| 926199 | 5/1963 | United Kingdom . |
| 1367424 | 9/1974 | United Kingdom . |

*Primary Examiner*—Mark Rosenbaum
*Assistant Examiner*—Willmon Fridie, Jr.
*Attorney, Agent, or Firm*—Gary L. Griswold; Walter N. Kirn; Charles D. Levine

[57] ABSTRACT

An apparatus for binding a plurality of sheets of paper together is disclosed. A pair of clamping plates presents one edge of the sheets for binding after a jogging plate aligns the edges. After a solid hot melt adhesive material sheet is placed along the edge of the sheets, a heating platen heats and melts the hot melt adhesive material sheet and causes the liquid adhesive to bind the sheets together. The method of binding the stack of a plurality of sheets of paper includes positioning a plurality of sheets between the clamping plates, vibrating the sheets to square and align their edges, clamping the aligned sheets of paper, presenting the aligned edge of the paper to the heating platen, placing an adhesive hot melt material sheet on the edge of the sheets, heating and melting the hot melt adhesive material sheet onto the edge, and removing the bound sheets from the apparatus.

14 Claims, 6 Drawing Sheets

HOT MELT ADHESIVE APPLICATOR

This is a continuation of application No. 07/876,486 filed Apr. 30, 1992, which is a continuation of application No. 07/594,640, filed on Oct. 4, 1990, now U.S. Pat. No. 5,152,654, issued on Oct. 6, 1992.

TECHNICAL FIELD

The present invention relates to an apparatus and method for binding a stack of papers together. More particularly, the present invention relates to an apparatus and method for applying a hot melt adhesive onto one edge of a stack of papers to bind the papers together in a plurality of pads.

BACKGROUND OF THE INVENTION

Binding sheets of paper into pads is generally accomplished by bonding or treating one edge of the sheets with a liquid adhesive using rollers or brushes and weights, and allowing the adhesive to dry or set, which can take hours or even days. To reduce the setting time, it is known to use solid, hot melt adhesives which can be heated to melt the adhesive and bind the sheets. Many methods heat the hot melt adhesive in a container and then apply the liquid adhesive to the sheets by dipping or immersion plates. More recent methods include placing a solid hot melt adhesive on a backing against the edge of the sheets to be bound and heating and melting the adhesive onto the sheets. Apparatus and methods using backed solid hot melt adhesives to bind conventional paper sheets are now common.

U.S. Pat. No. 3,531,358 to Rost discloses one such apparatus for binding stacked sheets. In Rost, the sheets are first jogged to align the edge to be bound, before being clamped. The jogging plate doubles as a hot plate and heats and melts a thermally flowable adhesive on a backing onto the edge of the sheets. The hot plate heats for twenty minutes. However, the adhesive is also disposed and melted onto the side of the outermost sheets, and the adhesive is placed underneath the sheets during binding. Additionally, there is no disclosure that this system can be used to bind carbonless forms. A binding system disclosed at page 112 of the Jan. 22, 1990 issue of *Design News* describes a similar heating and binding system.

Hoff, U.S. Pat. No. 3,616,074 is directed to a similar binding apparatus. In Hoff, the sheets of paper are indexed between three operating stations. In a first station, the sheets are clamped and jogged to align their edges. In the second station, a heating platen heats a backed sheet of hot melt material to the edges of the sheets. The adhesive is wrapped around and melted onto the sides of the sheets using additional heaters at the third station. However, the adhesive is placed underneath the sheets during binding and carbonless forms are not discussed.

U.S. Pat. No. 3,757,736 to Anderson discloses a semi-automatic bookbinder which uses a roll to coat a liquid hot melt adhesive onto the edge of a paper stack. The stack is clamped, vibrated to align the edge, and then rotated 180° to a heating and bonding station. The edge is preheated before the adhesive is rolled on.

Decker, U.S. Pat. No. 3,717,366, Abildgaard et al., U.S. Pat. No. 3,532,363, and Waldeck, U.S. Pat. No. 3,930,082 are representative of a large body of art involving the binding of conventional stacks of paper into pads or books using solid, backed hot melt type adhesives. None of these patents discloses placing the adhesive on top of the sheets to facilitate binding. Additionally, there are no known teachings to use backless, solid, hot melt adhesives to bind a stack of paper.

SUMMARY OF THE INVENTION

The present invention is an apparatus and method for hot melt binding a stack of paper that overcomes the deficiencies of and improves upon known binding systems. The apparatus binds the stack in minutes and can be used in office environments and back room printing operations. Prior systems, such as those discussed above, require much longer time to bind, are not geared to small scale operations, and are very expensive. Additionally, the apparatus of the present invention uses hot melt adhesives which bond at low temperatures, without odor, charting of the paper, or chemical breakdown of the adhesive. Moreover, the hot melt adhesives bond without the emission of vapors which harm the environment, create health hazards, and deteriorate hardware.

The apparatus binds a stack of sheets of paper together as one or more multi-sheet pads having at least two sheets. Where a plurality of multi-sheet pads or form sets of carbonless forms is to be bound, the outer surface of at least one of the two end sheets of the pads to be formed is chemically pretreated with a low adhesion coating to prevent adjacent pads from bonding to each other. This also increases the ability of the bound stack to "fan out" and separate the individual multi-sheet pads after binding.

A clamping subsystem presents one edge of the stack of paper for binding and includes a pair of clamping plates for clamping the stack. The clamping plates open and close to receive and clamp the stack therebetween, and a slip clutch controls the amount of pressure applied to the sheets of paper between the clamping plates.

An adhesive handling subsystem involves placing an unbacked hot melt adhesive material sheet along the edge of the sheets of paper. The adhesive material sheet is manually unwound from a roll, measured, cut from the roll, and placed on the edge of the sheets. A heating subsystem, including a heating platen, then heats and melts the hot melt adhesive material sheet and causes the liquid adhesive to penetrate the seams between the sheets of paper to bind the sheets together. Heat loss is prevented by non-heat absorbing insulation on the edge of the clamping plates.

An aligning subsystem aligns the sheets of paper before clamping and includes a vibrating plate which vibrates the sheets to align the edge of the sheets prior to binding. The clamping plates are rotatable in a vertical plane from a position adjacent the vibrating plate to a position adjacent the heating subsystem in which the adhesive is heated and melted.

DETAILED DESCRIPTION OF PREFERRED EMBODIMENTS

The figures illustrate an apparatus for binding a plurality of sheets of paper as at least one multi-sheet pad or book having at least two sheets. Throughout this specification, the terms "binding" and "bonding" will be used interchangeably as the present invention binds paper together by bonding. Preferably, the apparatus is used to bond together a plurality business forms, such as carbonless or noncarbonless sheets, into a plurality of multi-sheet pads or form sets. Where a plurality of form sets of carbonless forms is to be made, the outer surface of at least one of the two end sheets of the form sets is chemically pretreated with a low adhesion coating to prevent adjacent pads from bonding to each other. This also increases the ability of the bound stack to fan out or fan apart and separate the individual multi-sheet pads after binding.

Additionally, the apparatus can be used to bond together sheets into reports and books quicker, cheaper, and with stronger bonds than known binding methods and without the adverse side effects otherwise associated with known binding methods. Using this apparatus, books can be bound with less adhesive, less than 0.254 mm (0.01 in) thick versus 0.508 to 0.762 mm (0.02 to 0.03 in) with known systems, and with stronger adhesive, while reaching production speeds faster than existing binding systems. Moreover, books bound with this apparatus have a longer shelf life and last longer as the binding is much stronger. Furthermore, when opened, books bound using the apparatus can lay flat without breaking the spine. Also, book signatures can be bound without additional treatment of the edges. Punching holes in the signature folds and toughening the folds to expose the paper fibers to improve adhesive absorption are not required. Furthermore, book casings can be assembled by simply placing the casing on the edge of the bound sheets using the same adhesive that binds together the sheets before the adhesive dries. Where the book binding system is automated, the bound sheets need not be rotated to receive the book cover as the sheets are bound on the top edge rather than the bottom edge. Throughout this specification, "book" refers to any collection of bound sheets of paper having a cover, regardless of the number of sheets of paper or the quality of the cover.

The apparatus includes a plurality of subsystems. A clamping subsystem presents one edge of the stack for bonding, and an aligning subsystem aligns the edges of the stack. Another subsystem measures, dispenses, and permits placing a solid hot melt adhesive material sheet on top of and along the edge of the stack of paper. Finally, a heating subsystem heats and melts the hot melt adhesive material sheet and causes the liquid adhesive to bond the stack together. An electronic control center actuates the heating subsystem.

Figure 1:
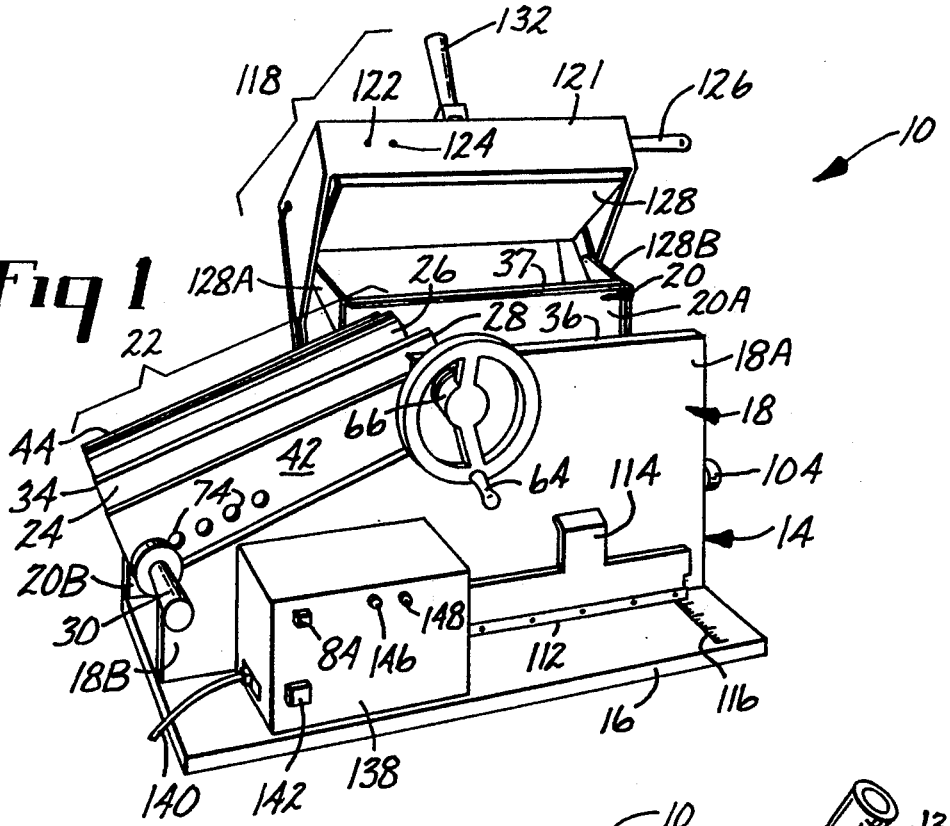
FIG. 1 is a perspective view of a hot melt adhesive applicator according to the present invention in a position ready to begin the binding process.
Figure 3:
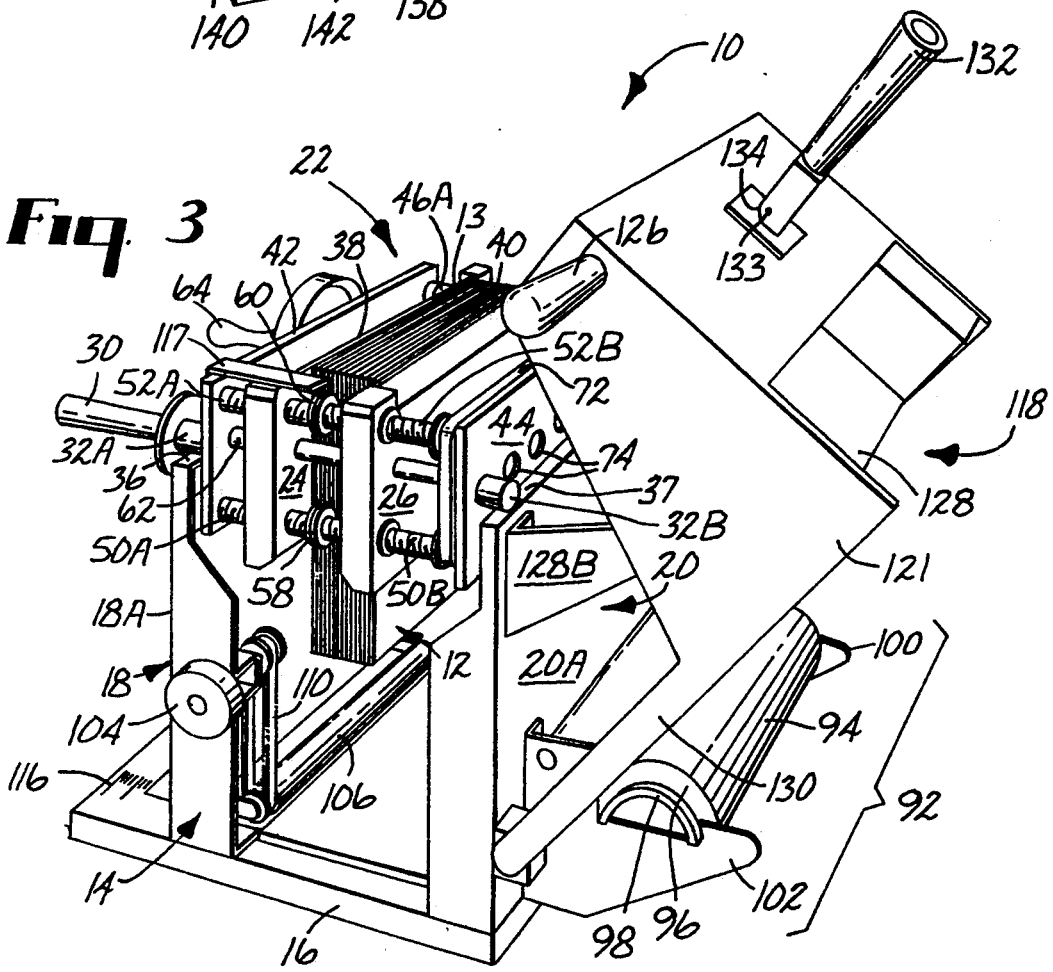
FIG. 3 is a perspective view of the applicator of FIG. 1 with the paper in position to receive a solid sheet of hot melt adhesive.
Figure 2:
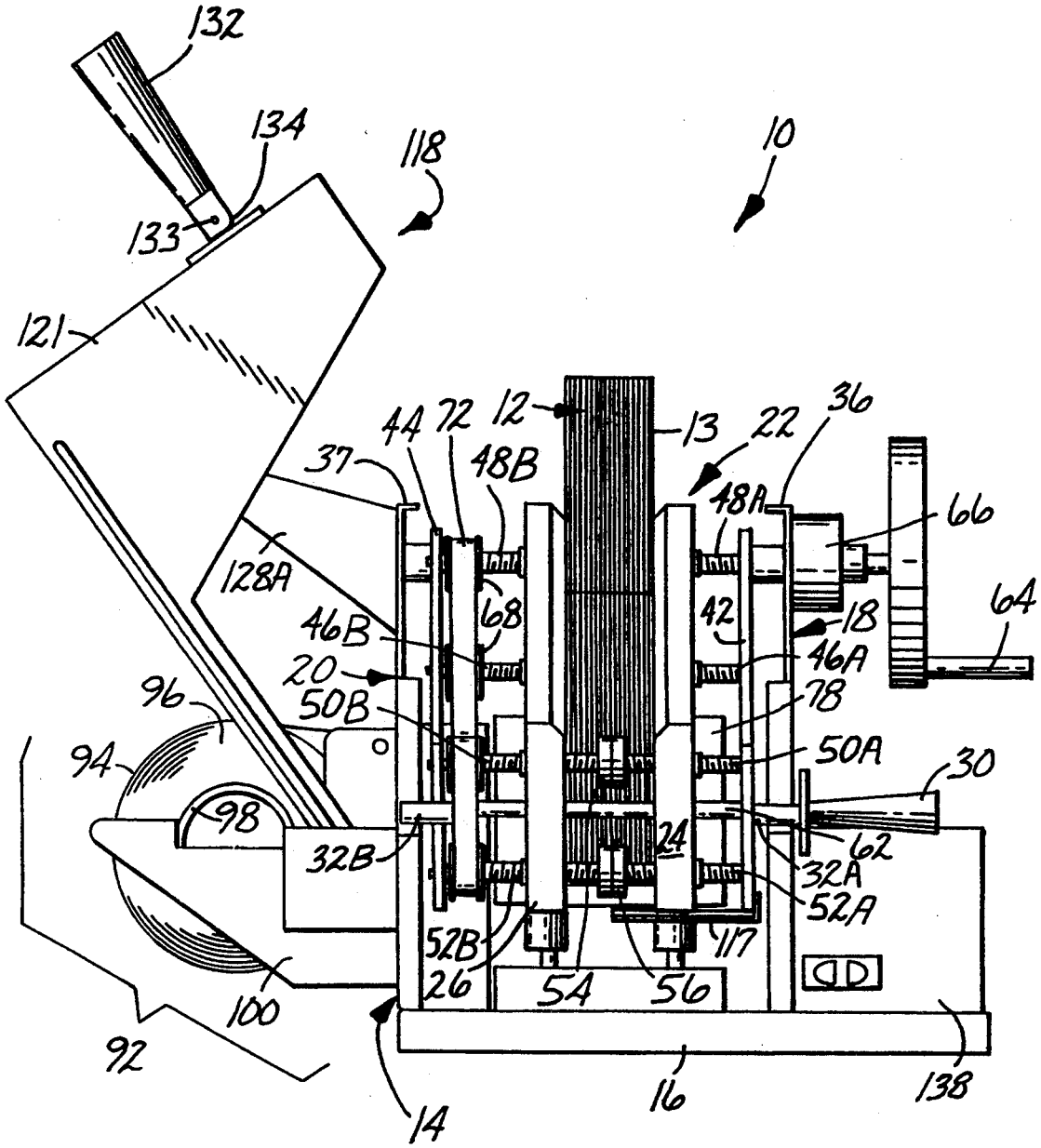
FIG. 2 is a left side view of the applicator of FIG. 1 with a stack of paper inserted between the clamping plates.

As shown in FIGS. 1–3, the apparatus 10 is formed of a main frame 14 which includes a base plate 16 and parallel front and rear walls 18 and 20, respectively. The base plate 16 is substantially rectangular while the front and rear walls 18, 20 include opposing rectangular portions 18A, 20A, and opposing trapezoidal portions 18B, 20B. The rectangular portions 18A, 20A define the heating area and the trapezoidal portions 18B, 20B define the aligning area. There are no side or top walls.

Figure 4:
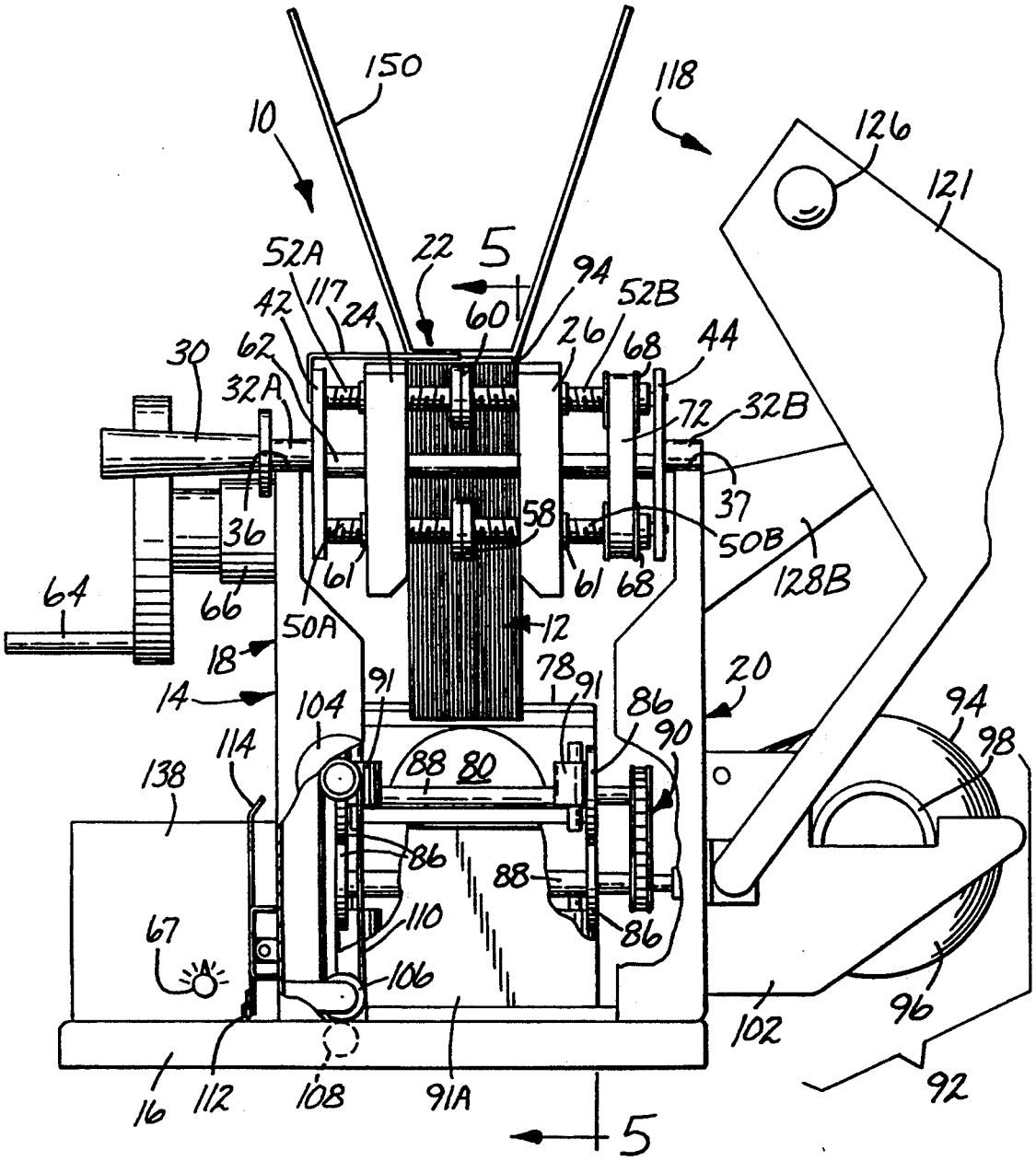
FIG. 4 is a right side view of the applicator of FIG. 1.

The clamping subsystem 22, shown best in FIGS. 2, 3, and 4, presents one edge 13 of the stack of sheets of paper 12 for binding and includes front and rear clamping plates 24, 26 for clamping the stack 12. The clamping plates 24, 26 are rotatable together at a mounted end 28 which is mounted between the front and rear walls 18, 20 at approximately the junction between rectangular portions 18A, 20A and trapezoidal portions 18B, 20B, respectively. A clamp handle 30 having a handle stop 32 is mounted at the opposite, free end 34 of the front clamping plate 24. The clamp handle 30 permits the clamping plates 24, 26 to be manually rotated in a vertical plane through an angle of at least 180°. The clamping plates 24, 26 rotate from the position shown in FIGS. 1 and 2 in which the stack 12 can be aligned, to the position shown in FIGS. 3 and 4 in which the edge 13 of the stack 12 is in position for binding. The handle stop 32 includes two portions as shown in FIG. 4. The handle stop 32A engages the top surface 36 of the front wall rectangular portion 18A and the handle stop 32B engages the top surface 37 of the rear wall rectangular portion 20A to position the clamping plates 24, 26 in the heating position.

The clamping plates 24, 26 maintain a generally constant temperature profile across the edge 13 of the sheets of paper 12 to facilitate adherence of the adhesive material 94 onto the sheets of paper by preventing the adhesive material 94 from setting up or drying before the paper sheets 12 are properly bound. Preferably, an insulation material 38, 40 is formed along respective edges of the plates 24, 26 which receive the edge 13 of the paper stack 12. The insulation material 38, 40 preferably isolates the heat generated at the heating position from the clamping plates 24, 26 by not conducting or absorbing heat. This isolates the heat in the paper in the stack 12 from the clamping plates 24, 26 which otherwise would serve as a heat sink and draw heat from the paper. One test indicates that when insulation is added to the clamping plates 24, 26, the temperature difference between the middle of a paper stack and the end of the stack drops from 43° C. to 6° C. The insulation material 38, 40 also prevents burn injuries and can be formed of various materials such as 90 durometer silicone rubber, epoxy, or a refractory ceramic material.

The preferred adhesive, particularly for use with carbonless forms, is an EVA film without a carrier backing such as an adhesive including 20–50% EVA copolymer having a melt index of from 150 to 1000, 20–50% tackifying resin, and 20–60% paraffin wax having a melting point of at least 70° C. and primarily including $C_{35}$–$C_{70}$ substantially straight-chain hydrocarbon which tends to cool and set up at temperatures below 88° C. Thus, the stack 12 must remain above this temperature while the adhesive melts. This adhesive is described in commonly assigned U.S. Pat. application Ser. No. 237,544 filed on Aug. 29, 1988, entitled "Edge-Bonded Sets of Carbonless Copy Paper," the specification of which is incorporated by reference. Other adhesives also can be used.

As an alternative to using insulation material 38, 40 along the clamping plate edges, the clamping subsystem 22 could have a heating apparatus located within the clamping plates 24, 26. A heater (not shown) would be disposed in each clamping plate 24, 26 along the entire length on the inside surface of each clamping plate to heat the sides of the paper stack 12 adjacent the edge 13 to improve the bonding. After the paper stack 12 is bound it is cooled. The stack of paper 12 can also be preheated to reduce the time required for the entire process.

Outer bearing support plates 42, 44 are disposed on the outside of respective clamping plates 24, 26. Four sets of coaxial threaded screws, which are ball screws 46A and 46B, 48A and 48B, 50A and 50B, and 52A and 52B in the illustrated embodiment, extend between and are fixed to the outer bearing support plates 42, 44. Each pair of ball screws is connected between the clamping plates 24, 26 by respective screw connections which are illustrated as split collar connections 54, 56, 58, 60. Nuts 61 are disposed around the ball screws 46, 48, 50, 52 adjacent the clamping plates 24, 26 to prevent slippage of the clamping plates on the ball screws. The clamping plates 24, 26 are always centered between the outer bearing support plates 42, 44 so that the paper stack 12 is centered in the heating position during heating. The ball screw set 50A and 50B serves as the pivot at the mounted end 28 of the clamping plates 24, 26 and therefore screws 50A and 50B also pass through the front and back walls 18, 20 of the main frame 14.

The clamping plates 24, 26 translate together and apart along a clamping plate guide bar 62 which extends between the two outer bearing support plates 42, 44. The clamping plate guide bar 62 also provides a paper stop position against which the paper stack 12 can rest. The clamping plates 24, 26 and the support plates 42, 44 have a series of axially aligned holes 74 which receive a rod (not shown) which serves as the paper stop when shorter stacks of paper 12 are being bound. Relative translation of the clamping plates 24, 26 is accomplished by manual operation of a pressure adjusting handle 64. The handle 64 translates the clamping plates 24, 26 through a mechanical pulley system including a pulley 68 located coaxially with each respective ball screw 46B, 48B, 50B, 52B, and mounted on the rear clamping plate 26. The pulleys 68 and belt 72 are used in a known manner to insure that all four corners of both clamping plates 24, 26 translate the same distance to maintain the clamping plates in parallel with each other.

The pressure adjusting handle 64 operates through a 24 v DC electrical clutch 66. The applied voltage to the clutch 66 corresponds to a slip value which thereby corresponds to a clamping force. The handle 64 is mounted on the front wall rectangular portion 18A, and the clutch 66 is adjustable based on the width of the paper stack 12 to provide a predetermined pressure to the clamped stack 12. The pressure is manually selected on an adjustment knob 67 mounted on electrical control box 138 and is calibrated based on the stack width. Alternatively, the clamping force can be self-adjusting using feedback controls. Feedback can be provided from sensors such as pressure sensitive resistance strips and can be used to control a clamping motor arrangement. The width of the stack 12 does not affect the pressure across the stack 12 within the preferred width range of 0.3 cm to 30 cm as the pressure is equally distributed through the stack 12 by the paper. After the desired clamping pressure is reached, the clutch slips and further rotation of the handle 64 will not move the clamping plates 24, 26.

This pressure limiting feature is critical when carbonless forms are to be bound. Carbonless paper construction generally includes at least two substrates, a donor sheet and a receptor sheet. Encapsulated color-formers dissolved in a solvent within microcapsules are coated onto a back side of the donor sheet. A developer is coated onto a front side of a mating receptor sheet, which faces the donor sheet back side. When an activating pressure is applied to the face of the donor sheet, the capsules rupture and transfer the color-formers to the developer on the receptor sheet to form a color pattern corresponding to the pressure points. Thus, the pressure exerted by the clamping plates 24, 26 must be carefully regulated. Pressures greater than 344,700 $N/m^2$(50 psi) can not be used because at these pressures the microcapsules in the carbonless paper would break, rendering the forms useless. Pressures below 275,800 $N/m^2$(40 psi) are also not preferred as this minimum pressure provides the necessary capillary action to effectuate proper bonding and flow of adhesive into the stack of paper 12 as increasing the pressure increases the adhesive distribution. Nonetheless, lower pressures also can be used although they yield less optimum results.

When binding carbonless forms, it is desirable to clamp the stack of paper 12 as close to the edge 13 as possible to maintain the desired levels of pressure at this critical location. However, in some applications it may be desirable to clamp the stack 12 a small distance away from the edge 13. This permits the paper sheets to separate slightly to promote adhesive flow. The clamping distance from the edge is critical; if the distance is too large additional adhesive is required and if the distance is too small not enough bonding occurs. Additionally, in this configuration the paper itself can act as an insulator and separate insulation or heaters on the clamping plates 24, 26 may not be necessary.

Figure 5:
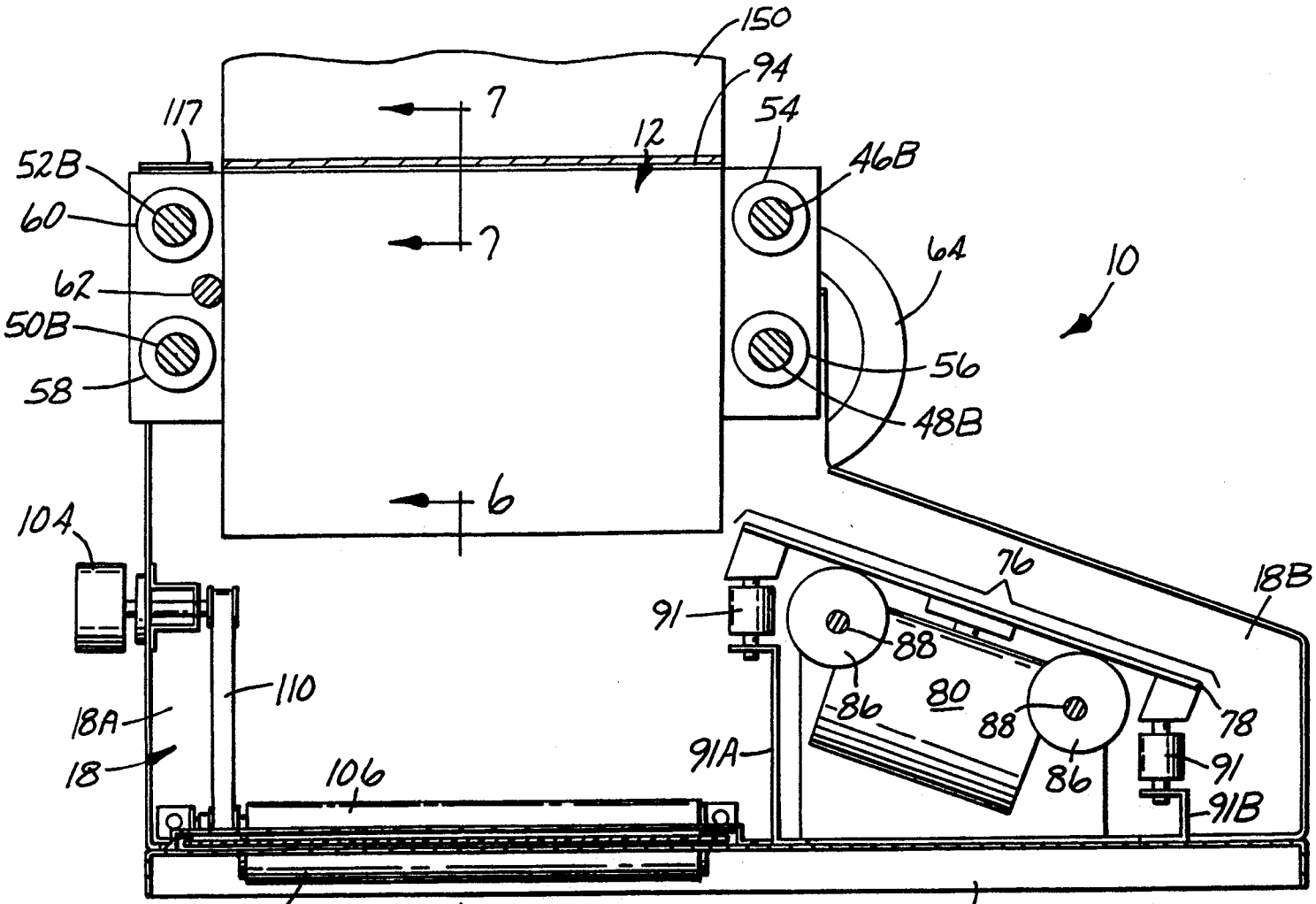
FIG. 5 is a sectional view of the applicator taken along line 5—5 of FIG. 4.

When the stack of paper 12 is first placed between the two clamping plates 24, 26, but before the stack is clamped, the aligning subsystem 76, shown in FIG. 5, aligns the stack 12 so that the edge 13 is square for binding. The aligning subsystem 76 includes a vibrating or jogging plate 78 which vibrates the sheets of paper to align at least the edge 13. The jogging plate 78 is disposed between the trapezoidal portions 18B, 20B and, as shown, is parallel to the upper open surface bridging trapezoidal portions 18B and 20B. Thus, the jogging plate 78 lies at an angle with the horizontal and the paper stack 12 between the clamping plates 24, 26 rests against the clamping plate guide bar 62 which holds the paper stack 12 in position. The jogging plate 78 is activated for vibration by a vibrator 80 which is mounted to the under surface of the jogging plate 78. The vibrator 80 can operate via rotating cams, a solenoid, or other devices, and includes a motor which is actuated via a switch 84. The motor operates the vibrator 80 for a time period electronically adjustable and constrained by the rotation of a motor cam (not shown).

The jogging plate 78 is also vertically translatable between an upper position when paper is inserted and clamped and a lower position when the stack 12 is jogged. In the upper position the clamping plates 24, 26 can clamp the paper stack 12 at the edge 13 with a sufficient amount of pressure, and in the lower position, away from the clamping plates 24, 26, the vibrations are not transmitted to the clamping plates. The vertical translation of the jogging plate 78 is activated by operation of four cams 86, one at each corner of the jogging plate 78. The cams 86 are mounted on rotatable camshafts 88 supported in the main frame 14. A chain and gear system 90 connects the camshafts 88 for uniform rotation. Rubber vibration dampeners or isolators 91 are mounted on mounts 91A, 91B in the main frame 14 to isolate vibration from the rest of the apparatus 10.

Figure 6:
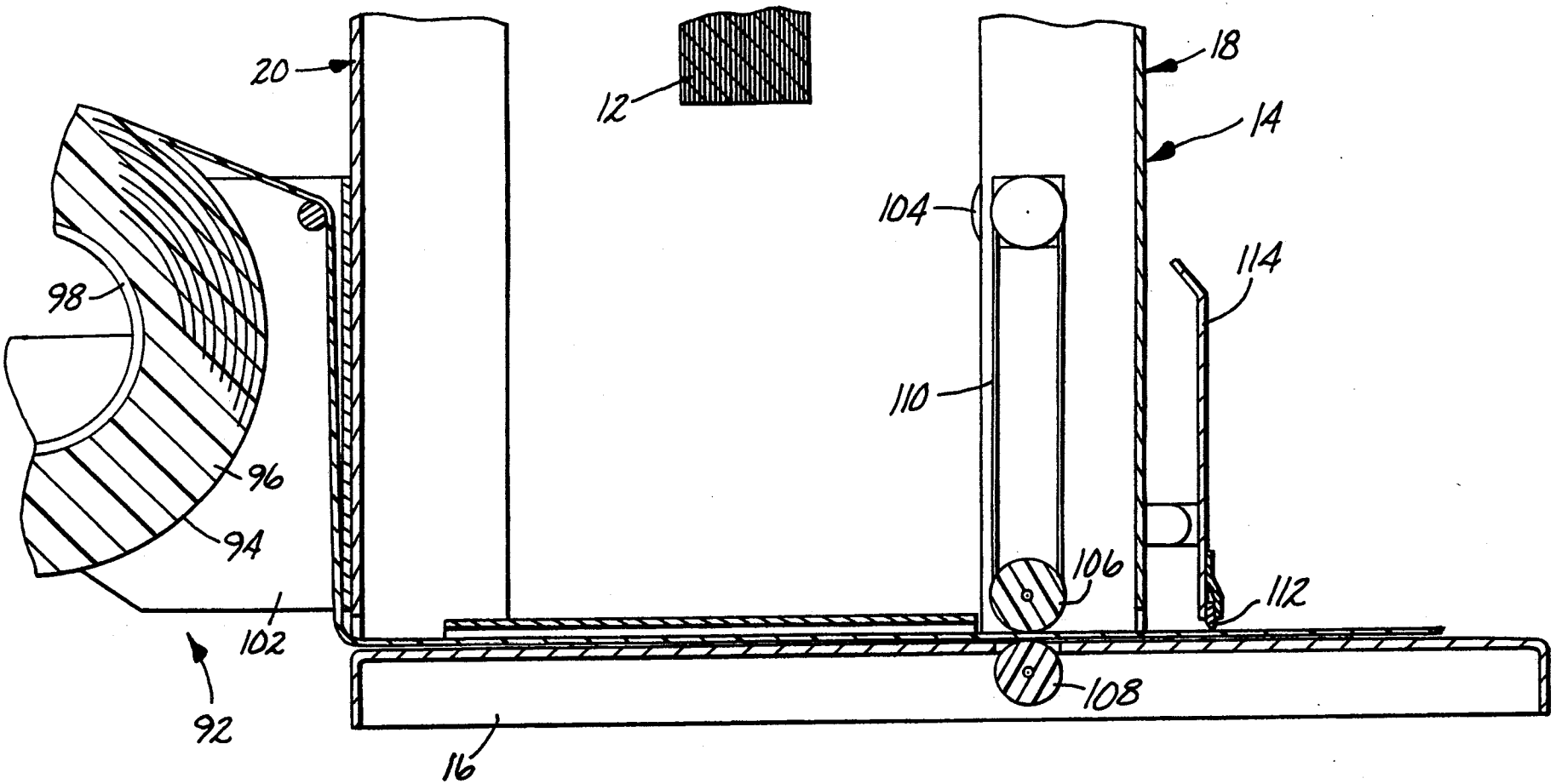
FIG. 6 is a sectional view of the applicator taken along line 6—6 of FIG. 5 showing the adhesive handling subsystem.
Figure 7:
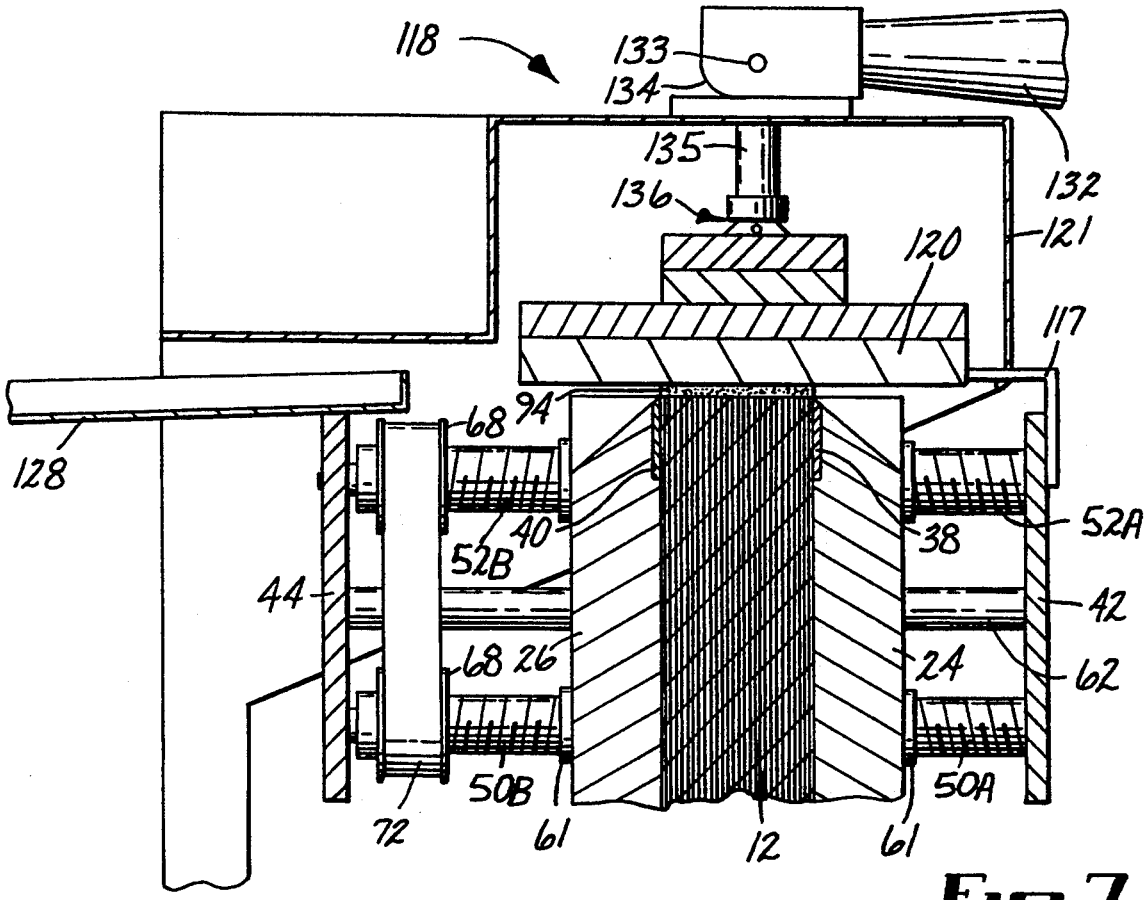
FIG. 7 is a partial sectional view of the applicator taken along line 7—7 of FIG. 5 with the hot melt adhesive positioned on the edge of the stack and the heating platen moved in position to heat and melt the adhesive.
Figure 8:
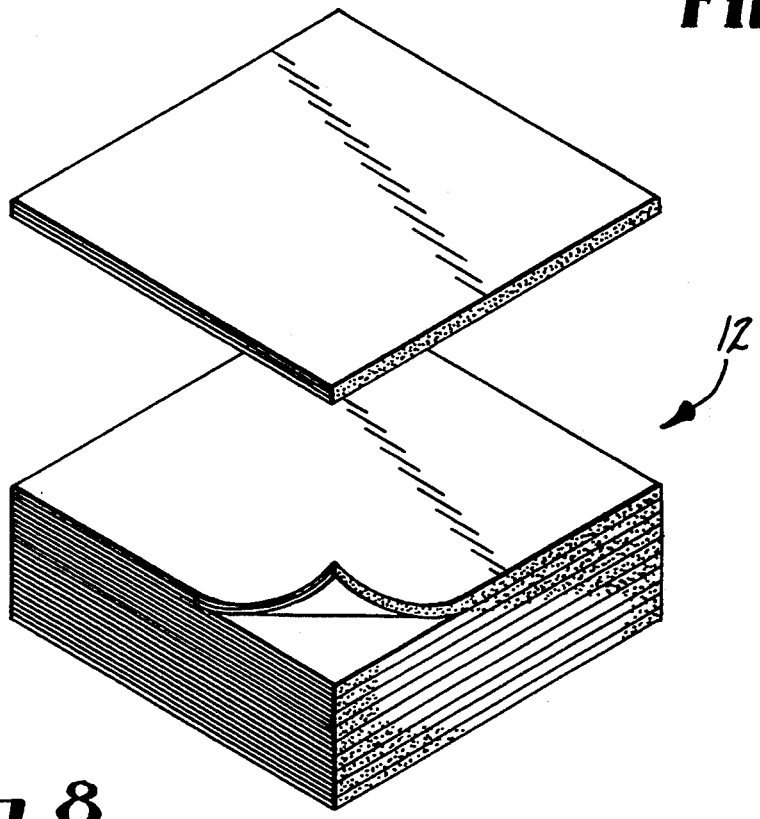
FIG. 8 is a perspective view of a stack of carbonless forms bound by the apparatus of FIG. 1.

The adhesive handling subsystem 92, shown best in FIG. 6, involves manually placing a solid hot melt adhesive material sheet 94 on top of the horizontal, aligned edge 13 of the stack 12. The adhesive material 94 is formed into a roll 96 mounted on a core 98 which is rotatably mounted between two core end supports 100,102 fixed on the rear wall 20. A feed knob 104 is mounted on the side of the front wall 18. Rotation of the feed knob 104, which is manual in the illustrated embodiment, rotates a pair of nip rollers 106, 108 via a cogged belt 110. The nip rollers 106,108 feed adhesive material 94 from the roll 96, under the rear wall 20, across the base plate 16, and under the front wall 18.

A pivotable cutting blade 112 is mounted at the lower front side of the front wall 18 adjacent the base plate 16. The cutting blade 112 is manually raised by pushing a spring loaded lever 114 which is formed as part of the blade 112 in the illustrated embodiments to permit the passage of the adhesive material sheet 94 thereunder when the feed knob 104 is rotated. A measuring guide 116 is printed on the base plate 16 perpendicular to the plane of the front wall 18 in the direction of adhesive material movement. As adhesive material 94 is fed in front of the front wall 18, the desired amount can be measured by the measuring guide 116 to permit dispensing the desired amount of adhesive. When the desired amount of adhesive material 94 is unwound from the roll 96, lever 114 is released and the cutting blade 112 is lowered to a position in which it clamps the adhesive material 94 between the base plate 16 and itself to permit manual tearing of the adhesive material 94. The length of the adhesive material 94 can be cut if it does not already correspond to the length of the paper stack 12. Alternatively, cutting can be automated or the adhesive material 94 can be precut into strips having the desired length and width for a particular paper stack application.

The desired amount of adhesive material 94 is equal to the width of the paper stack 12 and is determined by measuring the stack width with ruler 117. The ruler 117 is fixed to the top surface of the front clamping plate 24 when the clamping plates 24, 26 have been rotated to present the aligned edge 13 for binding. The ruler 117 measures the width of the stack 12 using demarcations which are twice the distance from the midpoint between the two support plates 42, 44, which remains the same regardless of the stack width or position of the clamping plates 24, 26.

The heating subsystem 118, shown in FIGS. 1, 2, 3, and 7, heats and melts the hot melt adhesive material sheet 94 to cause the liquid adhesive to penetrate the seams between individual sheets of paper to bond the paper stack 12 together. The heating subsystem 118 includes a heating platen 120, shown in FIG. 7, although many various other heating apparatus can be used. The heating subsystem 118 is connected to a platen frame 121 by a gimbal or ball pivot joint 136 which permits the platen 120 to float or pivot in every direction although the platen 120 is restricted from complete rotation by a pin (not shown) which maintain the platen 120 properly aligned. The platen frame 121 pivots from an open position in which the platen 120 extends rearwardly of the main frame 14 as illustrated in FIGS. 1–4, to a closed position shown in FIG. 7 in which the platen 120 is disposed over and contacts the edge 13 of the paper stack 12 to heat and melt the adhesive material 94. The platen frame 121 is hinged to the lower outside portion of the rear wall 20.

Because the hot melt adhesive 94 has a melting point of approximately 88° C. and contains no carbon pigment, it has weak heat transfer characteristics and the heating platen 120 should contact the adhesive 94. The heating platen can include etched foil heaters (not shown) sandwiched between two thermally conductive metal plates (not shown), which can be aluminum. Two indicator lights 122, 124 are located on the front surface of the heating platen 120 to provide a visual indication of the heating status. Light 122 indicates that the platen 120 is heating to the required temperature and light 124 indicates that the platen 120 is at the required temperature. In operation, the heating platen 120 preferably heats to a temperature in the range of 116° C. to 146° C. and applies heat to the adhesive material 94 for ninety seconds. It has been found that the proper bonding occurs anywhere on the temperature-time plane between 116° C. and 146° C. and 60 seconds and 90 seconds. These parameters are used in bonding carbonless forms which are coated sheets of paper. When bonding noncoated sheets, it has been found that the time periods are approximately halved as the sheets absorb the adhesive 94 more quickly. Additionally, the time required to fully bond the adhesive 94 to the stack 12 increases with the amount of adhesive 94 used for bonding.

A handle 126 extends from the side of the heating platen frame 121 and is used to manually rotate the platen 120 between its open and closed positions. A heater guard 128 is pivotably connected by arms 128A, 128B to the heating platen frame 121 underneath the platen 120. When the platen 120 is disposed in its open position it is covered by the heater guard 128 to prevent access to the hot surfaces of the platen 120 from the front and to catch excess adhesive which drips from the platen 120. As the heating platen 120 pivots to the closed position the heater guard 128 is cammed downwardly to prevent access to the platen 120 from the rear.

A release handle 132 is located at the top of the heating platen 120 and is pivotable between a position parallel to the top of the platen 120 and a position perpendicular to the top of the platen 120. The release handle 132 is connected to the top of the platen 120 through a lifting cam 134. When the platen 120 is rotated into the closed position above and contacting the edge 13 of the paper stack 12 to be bound, pivoting the release handle 132 from its parallel position to its perpendicular position around its pivot point 133 causes the lifting cam 134 to vertically displace arm 135 which acts on the ball pivot joint 136 to lower the heating surface of the platen 120 into contact with the edge 13 to heat and melt the hot melt adhesive.

Capillary action is the preferred primary mechanism by which the adhesive flows into the stack 12 to bond the paper sheets together. Capillary action assists both the adhesion of the adhesive material 94 to the stack of paper 12 and the internal cohesion within the adhesive material 94. By placing the adhesive 94 on top of the stack 12 rather than below it, gravity overcomes the viscosity of the adhesive and assists rather than resists the flow and penetration of the adhesive in between individual sheets of paper in the stack 12. Thus, a variety of adhesives having a wide range of viscosities, strengths, and types can be used. In contrast, when the adhesive 94 is disposed on the bottom of the stack 12 as in existing systems, the adhesive does not wick into the stack 12. Moreover, the capillary action obviates the need to over heat the adhesive material 94 so that the adhesive flows sufficiently between the sheets of paper before the adhesive sets up. Furthermore, the improved flow of adhesive material 94 into the stack 12, overcomes any problems caused by the varying surface absorption properties of the paper.

Additionally, the platen 120 of the heating subsystem 118 does not push the adhesive 94 into the edge 13 of the stack 12. Ideally, the platen 120 applies zero pressure against the stack 12 and only contacts the adhesive material sheet 94 sufficiently to melt the adhesive 94 so that the gravity-assisted capillary action causes the liquid adhesive 94 to wick into and bond the stack 12 together. Putting pressure on the adhesive 94 in an attempt to push it into the stack 12, whether pushing downwardly, upwardly, or sideways, would not enhance bonding. Rather, this would squeeze the adhesive off of the edge 13 and off of the stack 12 through the sides between the platen 120 and the stack 12 and defeat the effects of capillary action. Thus, the platen is designed to apply only minimal pressures on the edge 13 of the stack 12 to maintain contact between the platen 120, the adhesive 94 and the stack 12.

The electrical systems of the binding apparatus 10 are housed in an electrical control box 138 mounted on the base plate 16 in front of the front wall trapezoidal portion 18B as illustrated in FIGS. 1, 2, and 4. The control box 138 includes an AC power supply cord 140 and a power switch 142 mounted on the front of the box 138 for turning on and off the power to the apparatus 10. A jogging activation switch 84 is also mounted on the front of the control box 138 and controls the aligning subsystem 76. Two indicator lights 146, 148 are located on the front of the control box 138 to provide a visual indication of the bonding status. Light 146 illuminates when melting and bonding are in progress and light 148 illuminates when melting and bonding are complete. A timer (not shown) indicates the amount of time the heating platen 120 operates. The timer is preset for the desired heating time and is initiated by the release handle 132. Heating and timing begins when the release handle 132 begins moving toward its perpendicular position to lower the platen 120 into contact with the stack edge 13. The clutch adjustment knob 67 on the side of the control box 138 controls the amount of pressure supplied by the clamping plates 24, 26 to the stack of papers 12.

The method of binding the stack of paper 12 together in pad form includes the following steps. First, a stack of paper 12 is positioned between the clamping plates 24, 26, which are in the aligning position. The stack 12 is then jogged or vibrated by the jogging plate 78 of the aligning subsystem 76 to square and align the edge 13 of the stack 12. Next, the clamping plates 24, 26 are closed by rotating the pressure adjusting handle 64 to clamp the aligned stack 12 therebetween. The clamping subsystem 22 is rotated via handle 30 into the heating position to present the aligned edge 13 of the paper stack 12 to the heating subsystem 118. The width of the clamped stack of paper 12 is measured with ruler 117 and a corresponding width of adhesive hot melt material sheet 94 is fed from the roll of adhesive material 96 as measured by measuring guide 116. This desired amount of adhesive material 94 is cut from the roll 96 by tearing the adhesive material 94 across the cutting blade 112 and is placed on the presented edge 13 of the stack 12.

The heating platen 120 of the heating subsystem 118 is then positioned over the paper stack edge 13 with the adhesive material 94 and lowered onto the adhesive material 94. The hot melt adhesive material sheet 94 is heated to melt the hot melt adhesive material sheet 94 onto the edge 13 of the stack 12 to bond the sheets together. Indicators 122, 124 measure and limit the heating time, while indicators 146, 148 determine bonding completeness. After binding is completed, the heating platen 120 is raised and opened, and the clamping plates 24, 26 are rotated back to the aligning position. The bound sheets are then unclamped and removed from the apparatus 10.

When the apparatus is used to bond together sheets into reports and books, a cover can be secured to the bound stack 12. Books assembled using a hot melt adhesive are known as "perfectly bound" books. After the heating platen 120 melts the hot melt adhesive material sheet 94 onto the edge 13 of the stack 12 to bond the sheets together and binding is completed, the heating platen 120 is raised and opened. Before the hot melt adhesive 94 fully sets, typically within approximately 20 seconds when using the preferred adhesive, a preformed book cover 150 is placed onto the edge 13, as shown in FIGS. 4 and 5, so that the interior of the spine of the cover 150 adheres to the edge 13. This can be performed manually or automatically and is particularly useful in the preparation of manuals, guidebooks, pamphlets, and other soft-cover books. Where the book binding system is automated, the bound sheets need not be rotated to receive the book cover as the stack 12 is bound on the top edge rather than the bottom edge, although the clamping plates 24, 26 can be rotated back to the aligning position prior to applying the cover 150.

These perfectly bound books can be bound with less adhesive than with known systems, and have a longer shelf life and last longer as the binding is much stronger. Furthermore, books bound using the apparatus 10 can lay flat when opened, without breaking the spine or damaging the connection between the bound stack 12 and the cover 150. Consecutive pages on separate sheets (in the conventional page numbering scheme, an even-numbered page followed by the next odd-numbered page) can lay in substantially the same plane. Furthermore, books can be assembled by simply placing the cover 150 on the edge of the bound sheets using the same adhesive that binds together the sheets before the adhesive dries.

The binding apparatus 10 achieves many advantages over prior roll, spray, or paint coating apparatus when binding carbonless forms into pads. The cycle time to bond a stack is reduced from hours to a few minutes. Moreover, a complete stack of papers can be bound without wasting adhesive or wasting numerous sheets of paper due to the adhesive not binding the end sheets. This complete and uniform bonding is accomplished because the clamping plates are insulated to reduce heat dissipation and permit the end sheets to be sufficiently heated. Also, the bound sheets do not have wavy edges, and the bonds are stronger. Additionally, the precise positioning, pressure control, temperature control, and gravity-assisted adhesive flow improve adhesive penetration. This apparatus 10 can be used in environments having various scales, whether with desk top printing systems and copy machines or with large scale printing systems.

When bonding sheets, particularly noncoated sheets, it may be desirable to only wick half of the adhesive 94 into the sheets and allow the remainder of the adhesive 94 to solidify on the edge 13 to form a spine. In these instances, the platen 120 must be removed without pulling adhesive 94 away from the spine as the platen 120 is removed. It is inefficient to wait for the platen 120 to cool sufficiently before removing it from the adhesive 94. Therefore, the platen 120 should be removed by sliding it parallel to the plane of the edge 13 to maintain the smooth spine surface.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be effected therein by one skilled in the art without departing from the scope or spirit of the invention. For example, it is contemplated that the adhesive placement step be automated and that the entire system could be programmed to operate without human intervention.

We claim:

1. An apparatus for binding a plurality of sheets of paper together comprising:

a frame;

means mounted on the frame for presenting one edge of the sheets of paper in a substantially horizontal plane for binding, wherein the presenting means comprises a pair of clamping plates for clamping the sheets of paper therebetween;

means mounted on the frame for heating and melting a solid hot melt adhesive material sheet after the solid hot melt adhesive material sheet is placed on top of the edge of the sheets of paper to cause the liquid adhesive to penetrate the seams between the sheets of paper to bind the sheets of paper together while leaving substantially no adhesive on the outsides of the outermost of the sheets of paper; and means, separate from the heating and melting means, mounted on the presenting means for maintaining a temperature profile across the top of the edge of the sheets of paper at a sufficiently high temperature to prevent the adhesive material from drying before the paper sheets are properly bound and to facilitate adherence of the adhesive material onto the sheets of paper.

2. The apparatus of claim 1 wherein the sheets of paper are carbonless paper and apparatus binds the plurality of sheets of carbonless paper together to form a plurality of multi-sheet form sets having at least two sheets, and wherein substantially all of the liquid adhesive penetrates the seams between the sheets of paper to bind the sheets of paper together, while leaving substantially no adhesive on the outsides of the outermost of the sheets of paper.

3. The apparatus of claim 1 wherein the solid hot melt adhesive material sheet is backless, the heating and melting means melts the adhesive and binds the sheets by heating the hot melt adhesive material sheet to temperatures below 150° C. for a time period of less than two minutes, and wherein additional application of heat neither improves nor impairs binding, and the liquid adhesive penetrates the seams between the sheets of paper to bind the sheets of paper together without pressing the liquid adhesive downwardly into the seams between the sheets of paper.

4. The apparatus of claim 1 wherein the clamping plates clamp the sheets of paper adjacent the edge of the sheets and the temperature maintaining means comprises means for insulating the edge of the sheets of paper from the remainder of the apparatus.

5. The apparatus of claim 1 wherein the presenting means further comprises a slip clutch which controls the amount of pressure applied to the sheets of paper between the clamping plates.

6. The apparatus of claim 1 further comprising means for aligning the sheets of paper, the aligning means comprising a vibrating plate which vibrates the sheets of paper between the clamping plates to align the one edge of the sheets of paper prior to binding.

7. The apparatus of claim 6 wherein the clamping plates are rotatable in a vertical plane through an angle of at least 180° from a position adjacent the vibrating plate in which the sheets of paper are aligned to a position adjacent the heating and melting means in which the hot melt adhesive material sheet is heated and melted.

8. The apparatus of claim 6 wherein the vibrating plate is vertically translatable between an upper position in which the paper stack is inserted and clamped and a lower position, away from the clamping plates, in which the stack is vibrated and the vibrations are not transmitted to the clamping plates.

9. The apparatus of claim 1 wherein the heating means comprises a heating platen pivotably mounted on the frame, wherein the heating platen pivots between an open position in which the heating platen extends rearwardly of the frame and a closed position in which the heating platen is disposed over and contacts the edge of the sheets of paper.

10. The apparatus of claim 9 wherein the heating means further comprises a heater guard pivotable between a first position in which the heater guard is disposed against and covers the heating platen when the heating platen is in its open position and a second position in which the heater guard is disposed at a spaced location from the heating platen when the heating platen is in its closed position, wherein in both positions the heater guard prevents access to the hot surfaces of the heating platen and in the first position the heater guard catches excess adhesive which drips from the heating platen.

11. An apparatus for binding a plurality of sheets of carbonless paper together with a solid hot melt adhesive material sheet such that the sheets of paper are bound as a plurality of multi-sheet form sets having at least two sheets comprising:

a frame;

means mounted on the frame for presenting one edge of the sheets of paper in a substantially horizontal plane for binding, the presenting means comprising a pair of clamping plates for clamping the sheets of paper therebetween adjacent the edge, and a slip clutch which controls the amount of pressure applied to the sheets of paper between the clamping plates;

means movably mounted on the frame for heating and melting a solid hot melt adhesive material sheet placed on the top edge of the sheets of paper to cause the liquid adhesive to penetrate the seams between the sheets of paper to bind the sheets of paper together without pressing the liquid adhesive downwardly into the seams between the sheets of paper, wherein the heating means comprises a heating platen which heats and melts the adhesive and bind the sheets by applying heat at temperatures below 150° C. for a time period of less than two minutes, and wherein additional application of heat neither improves nor impairs binding;

means mounted on the presenting means for insulating the edge of the sheets of paper from the remainder of the apparatus to maintain a temperature profile across the top of the edge of the sheets of paper at a sufficiently high temperature to prevent the adhesive material from drying before the paper sheets are properly bound and to facilitate adherence of the adhesive material onto the sheets of paper; and means for aligning the sheets of paper comprising a vibrating plate which vibrates the sheets of paper between the clamping plates to align the edge of the sheets of paper prior to binding;

wherein the clamping plates are rotatable in a vertical plane through an angle of at least 180° from a position adjacent the vibrating plate in which the sheets of paper are aligned to a position adjacent the heating means in which the hot melt adhesive material sheet is heated and melted.

12. An apparatus for binding a plurality of sheets of paper together comprising:

a frame;

means mounted on the frame for presenting one edge of the sheets of paper in a substantially horizontal plane for binding, wherein the presenting means comprises a pair of clamping plates for clamping the sheets of paper therebetween;

means mounted on the frame for heating and melting a solid hot melt adhesive material sheet placed on top of the edge of the sheets of paper to cause the liquid adhesive to penetrate the seams between the sheets of paper to bind the sheets of paper together; and means mounted on the presenting means for restricting heat transfer from the sheets to the presenting means to maintain a temperature profile across the top of the edge of the sheets of paper at a sufficiently high temperature to prevent the adhesive material from drying before the paper sheets are properly bound and to facilitate adherence of the adhesive material onto the sheets of paper.

13. An apparatus for binding a plurality of sheets of paper together comprising:

a frame;

means mounted on the frame for presenting one edge of the sheets of paper in a substantially horizontal plane for binding, wherein the presenting means comprises a pair of clamping plates for clamping the sheets of paper therebetween;

means mounted on the frame for heating and melting a backless solid hot melt adhesive material sheet placed on top of the edge of the sheets of paper to cause the liquid adhesive to penetrate the seams between the sheets of paper to bind the sheets of paper together; and means mounted on the presenting means for maintaining a temperature profile across the top of the edge of the sheets of paper at a sufficiently high temperature to prevent the adhesive material from drying before the paper sheets are properly bound and to facilitate adherence of the adhesive material onto the sheets of paper.

14. An apparatus for binding a plurality of sheets of paper together comprising:

a frame;

means mounted on the frame for presenting one edge of the sheets of paper in a substantially horizontal plane for binding, wherein the presenting means comprises a pair of clamping plates for clamping the sheets of paper therebetween;

means mounted on the frame for heating and melting a solid hot melt adhesive material sheet placed on top of the edge of the sheets of paper to cause the liquid adhesive to penetrate the seams between the sheets of paper to bind the sheets of paper together without wrapping the liquid adhesive around and adhering the liquid adhesive to the outsides of the outermost sheets of paper; and means mounted on the presenting means for maintaining a temperature profile across the top of the edge of the sheets of paper at a sufficiently high temperature to prevent the adhesive material from drying before the paper sheets are properly bound and to facilitate adherence of the adhesive material onto the sheets of paper.

* * * * *